US006896478B2

(12) United States Patent
Botros et al.

(10) Patent No.: US 6,896,478 B2
(45) Date of Patent: May 24, 2005

(54) DUAL FAN BLOWER WITH AXIAL EXPANSION

(75) Inventors: Monier B. Botros, Troy, MI (US); Steve M. Kahrs, Canton, MI (US); Eric K. Haupt, Livonia, MI (US); Dennis A. Vermette, Westland, MI (US); Gerald B. Chendes, Jr., Milford, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 80 days.

(21) Appl. No.: 10/319,943

(22) Filed: Dec. 16, 2002

(65) Prior Publication Data

US 2004/0115039 A1 Jun. 17, 2004

(51) Int. Cl.[7] ..... F01D 3/02

(52) U.S. Cl. ..... 415/101; 415/102; 415/99; 417/350

(58) Field of Search ..... 415/101, 102, 415/99; 417/350, 423.15

(56) References Cited

U.S. PATENT DOCUMENTS 2,107,026 A 2/1938 Forrest et al.
2,325,222 A * 7/1943 Bretzlaff et al. ..... 417/350
3,856,431 A * 12/1974 Tucker ..... 417/350
4,082,142 A 4/1978 Blackburn et al.
4,171,190 A 10/1979 Hudson
4,672,819 A 6/1987 Mino et al.
4,746,266 A * 5/1988 Kirchner et al. ..... 415/119
4,898,003 A 2/1990 Ichikawa et al.
5,388,956 A * 2/1995 Pla et al. ..... 415/102
5,403,163 A 4/1995 Murphy
6,026,103 A 2/2000 Oliver et al.
6,030,173 A 2/2000 Bacchiocchi

* cited by examiner

*Primary Examiner*—Theresa Trieu
(74) *Attorney, Agent, or Firm*—Brinks Hofer Gilson & Lione

(57) ABSTRACT

A dual fan blower module of the present invention includes a housing defining a central motor compartment and first and second scroll chambers. The scroll chambers are axially aligned with and located on opposite sides of the motor compartment. A motor is mounted within the motor compartment and has first and second shaft ends extending axially therefrom. The first shaft end extends into the first scroll chamber and the second shaft end extends into the second scroll chamber. A first fan is mounted onto the first shaft end within the first scroll chamber for rotational movement within the first scroll chamber and a second fan is mounted onto the second shaft end within the second scroll chamber for rotational movement within the second scroll chamber. Each of the first and second scroll chambers includes an expansion channel extending axially inward toward the motor.

13 Claims, 5 Drawing Sheets

DUAL FAN BLOWER WITH AXIAL EXPANSION

BACKGROUND

1. Technical Field of the Invention

The present invention generally relates to a blower module mounted upstream of either a heat exchanger or air filter in an automotive ventilation system.

2. Description of the Prior Art

In most center mounted air-handling systems the blower scrolls have a constant depth extending circumferentially from a cut-off edge to the exit. These types of blower units are typically formed as an upper part and a lower part. The motor and the fan or fans are inserted in the lower part, and then covered by the upper part. Air enters the scroll chamber through an air inlet. As the air rushes axially toward the back of the fan and the scroll chamber, opposite the air inlet, a high pressure zone is created near the bottom of the scroll chamber, distal from the air inlet, and lower pressure-zone near the top of the scroll chamber, adjacent the air inlet. This pressure differential results in air circulation inside the scroll chamber between the high pressure zone and the low pressure zone, which reduces the efficiency and blower capacity of the system.

Further, the recent designs of these types of blower assemblies may include a secondary ring extending around the air inlet to reduce the amount of high pressure air leakage from the scroll chamber, back through the air inlet. Typically, these secondary rings have a diameter greater than the fan outer diameter and leveled axially with the fan ring that leaves minimal or no axial clearance between the top of the fan and the ring to allow the fan to be removed laterally from any side without completely dis-assembling the blower assembly.

Therefore, there is a need for a dual fan, single motor blower assembly which will reduce the amount of axial circulation of the air within the two scroll chambers for the two fans and thereby increase the efficiency and blower capacity of the blower assembly. Further, there is a need for a blower assembly that has a secondary ring and allows the fan or fans to be removed laterally from a side without completely dis-assembling the blower assembly.

A principle object of the present invention is to provide a dual fan, single motor blower assembly which will provide a reduced pressure differential between the air located near the bottom of the scroll chamber and the air located adjacent the air inlet, thus reducing the amount of axial air circulation within the scroll chamber and thereby increasing the efficiency and blower capacity of the blower assembly.

It is also an object of the present invention to provide a blower assembly that reduces the amount of air leakage from the scroll chamber between the fan and scroll inlet side to the air inlet and allows the fan or fans to be removed laterally from a side without completely dis-assembling the blower assembly.

SUMMARY

The above and other disadvantages of the prior art are overcome by providing a blower assembly, in accordance with a first aspect of the present invention, wherein the blower assembly is a dual fan, single motor blower assembly having a housing defining a motor compartment and first and second scroll chambers axially aligned with and located on opposite sides of the motor compartment, wherein each of the first and second scroll chambers includes an expansion channel extending axially inward toward the motor.

In another aspect of the present invention, each of the scroll chambers includes an air inlet adapted to allow air to enter the scroll chambers, a bottom side opposite said air inlet, and a generally cylindrical, curved wall with increasing radius between the air inlet side and the bottom side, thereby defining a volute chamber through which a volume of air passes, the scroll chambers terminating in an exit and defining a cut-off edge, each of the expansion channels having a start point and extending radially about the scroll chambers from the start point to the exit, wherein the start point of each of the expansion channels is located approximately thirty-five degrees radially from the cut-off edges in the direction of the fan rotation.

In still another aspect of the present invention each of the expansion channels has an axial depth that expands linearly as the expansion channels extend radially from the start point to the exit.

In yet another aspect of the present invention each of the expansion channels has a radial height that increases linearly as the expansion channels extend from the start point to the exit.

In still another aspect of the present invention the inlets of the first and second scroll chambers each include a primary inlet ring which radially over-laps the fan and a secondary inlet ring which extends axially into the scroll chambers beyond the fan to reduce air leakage between the fan and the primary inlet ring, wherein the secondary inlet rings extend radially about a portion of the inlets, thereby leaving an opening to allow the fans to be removed laterally to a side from the scroll chambers.

In yet another aspect of the present invention the blower module includes a passage extending from the expansion channel of one scroll chamber to the central motor compartment that is adapted to allow air to flow from that scroll chamber into the central motor compartment to cool the motor. The air flow through the motor frame and exits to the other scroll chamber.

DETAILED DESCRIPTION

The following description of the preferred embodiment of the invention is not intended to limit the scope of the invention to this preferred embodiment, but rather to enable any person skilled in the art to make and use the invention.

Figure 1:
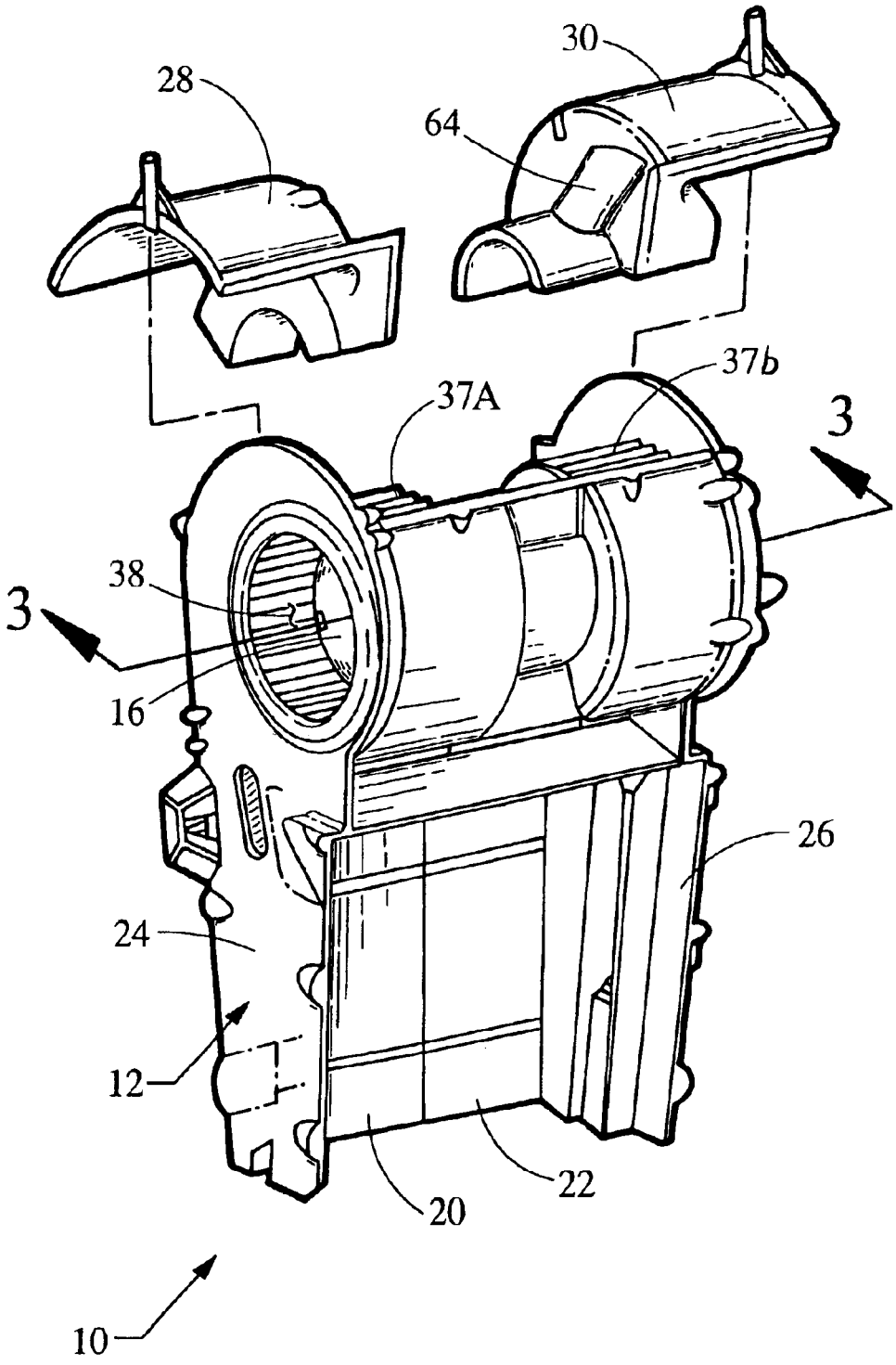
FIG. 1 is a perspective view of a blower assembly of the present invention.
Figure 2:
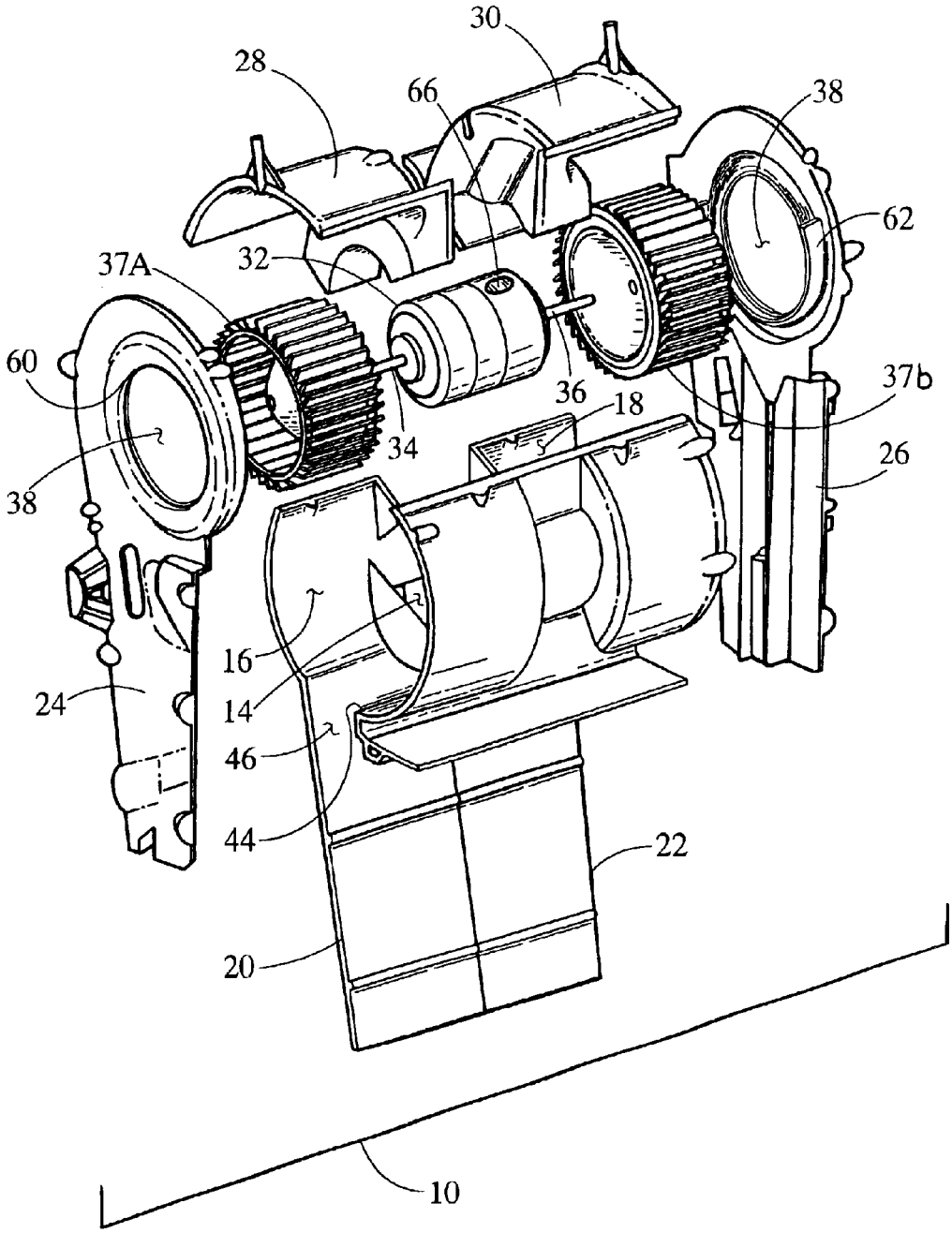
FIG. 2 is a partially exploded view of the blower assembly shown in FIG. 1.

Referring to FIGS. 1 and 2, a dual fan, single motor blower assembly of the present invention is shown generally at 10. The blower assembly 10 includes a housing 12 that defines a central motor compartment 14 and first and second scroll chambers 16, 18. The scroll chambers 16, 18 are axially aligned with and located on opposite sides of the motor compartment 14.

The housing 12 includes six separate pieces. A first lower housing 20 includes the first scroll chamber 16 and a second lower housing 22 includes the second scroll chamber. The first and second lower housings 20, 22 are attached to one another and include portions which define the central motor compartment 14 when they are attached to one another. A first side 24 is attached to the first lower housing 20 and a second side 26 is attached to the second lower housing 22. A first upper housing 28 is removably mounted onto the first lower housing 20 to enclose the first scroll chamber 16, and a second upper housing 30 is removably mounted onto the second lower housing 22 to enclose the second scroll chamber 18. The first and second upper housings 28, 30 include portions that enclose the central motor compartment 14 when the first and second upper housings 28, 30 are mounted onto the first and second lower housings 20, 22.

Figure 3:
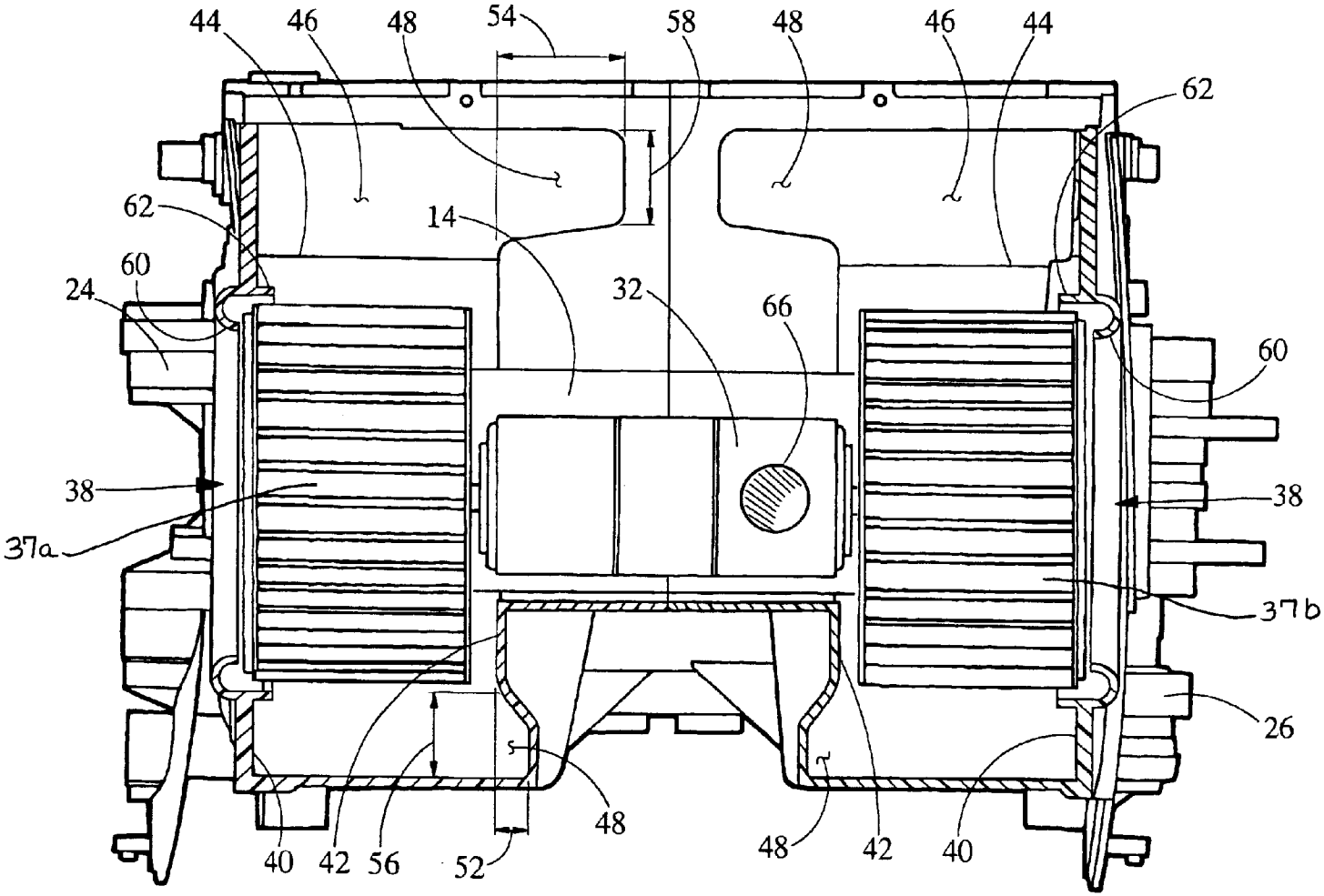
FIG. 3 is a sectional view taken along line 3—3 of FIG. 1.

Referring to FIG. 3, a motor 32 is mounted within the central motor compartment 14 and includes first and second motor shaft ends 34, 36 extending axially therefrom. The first shaft end 34 extends into the first scroll chamber 16 and the second shaft end extends into the second scroll chamber 18. Each of the first and second shaft ends 34, 36 includes a fans 37*a*, 37*b* mounted thereon and adapted for rotational movement within the first and second scroll chambers 16, 18.

Each of said first and second sides 24, 26 also includes an air inlet 38 adapted to allow air to flow into the first and second scroll chambers 16, 18. Each of the scroll chambers 16, 18 includes an air inlet side 40 adjacent the air inlet 38 and a bottom side 42 opposite the air inlet 38. A generally cylindrical, curved wall having an increasing radius extends between the air inlet side 40 and the bottom side 42, thereby defining a volute chamber through which a volume of air passes.

Figure 4:
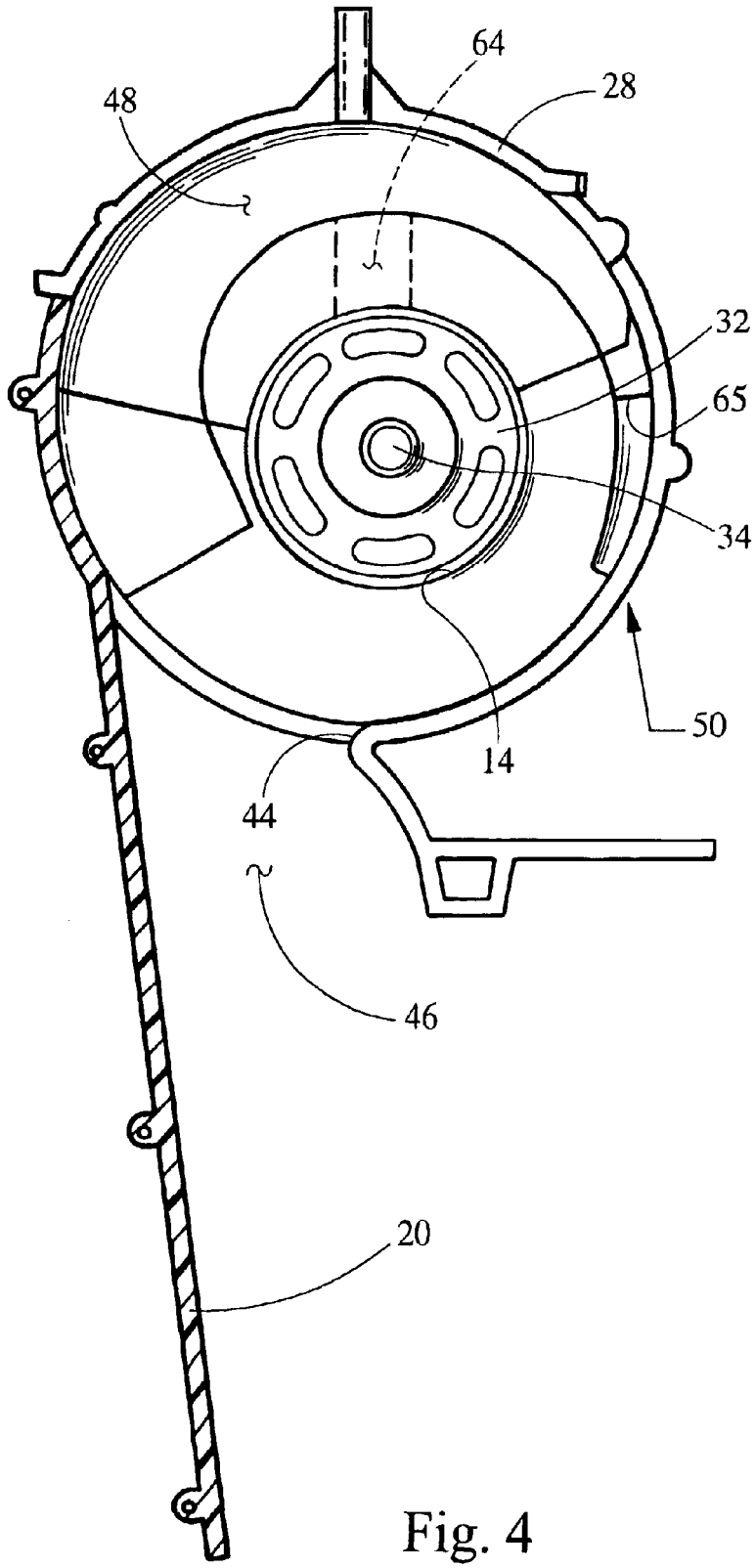
FIG. 4 is a side view of the blower assembly with a first side removed to expose a first scroll chamber.

Each of the first and second scroll chambers 16, 18 includes a cut-off edge 44 and an exit 46 adjacent the cut-off edge 44. Referring to FIG. 4, each of the first and second scroll chambers 16, 18 further includes an expansion channel 48 extending axially inward from the scroll chambers 16, 18, toward the motor 32. Each of the expansion channels 48 has a start point 50 and extends radially about the first and second scroll chambers 16, 18 from the start point 50 to the exit 46. Preferably, the start point 50 of each of the expansion channels 48 are located approximately thirty-five degrees circumferentially in the direction of fan rotation from the cut-off edges 44 of the scroll chambers 16, 18.

Referring again to FIG. 3, each of the expansion channels 48 has first axial depth 52 at the start point 50 and a second axial depth 54, larger than the first axial depth 52, at the exit 46. Preferably, the axial depth of the expansion channels 48 expands linearly from the first axial depth 52 at the start point 50 to the second axial depth 54 at the exit 46. Additionally, each of the expansion channels 48 has a first radial height 56 at the start point 50 and a second radial height 58, larger than the first radial height 56, at the exit 46. Preferably, the radial height of the expansion channels 48 expands linearly from the first radial height 56 at the start point 50 to the second radial height 58 at the exit 46.

As the fans 37*a*, 37*b* within the scroll chambers 16, 15 rotate, air is drawn inward through the air inlets 38 and into the center of the fan 37. The air is then expelled at higher pressure radially through the fans 37*a*, 37*b* and around the scroll channels 16, 18. As the air is drawn inward, the air rushes axially toward the bottom side 42 of the scroll chambers 16, 18, opposite the air inlet 38, a high pressure zone is created near the bottom side 42, and lower pressure zone near the air inlets 38. The expansion channels 48 allow the air near the bottom side 42 to expand outward into the expansion channels 48, thereby lowering the pressure near the bottom side 42. With less pressure differential within the scroll chambers 16, 18, there is less air circulation within the scroll chambers.

Preferably, each of the air inlets 38 includes a primary inlet ring 60 extending circumferentially around the entire periphery of air inlets 38. The primary inlet ring 60 has a semi-circular section and its inside diameter is approximately equal to the fan inside diameter. The primary inlet ring 60 extends radially to over-lap the outer diameter of the fans 37*a*, 37*b*. Preferably, each of the air inlets 38 further includes a secondary ring 62 extending circumferentially around the air inlets 38 at a radius greater than the outer radius of the fans 37*a*, 37*b*. The secondary rings 62 extend axially inward toward the motor to over-lap the fans 37*a*, 37*b* to prevent air leakage from the scroll chambers 16, 18 around the fans 37*a*, 37*b*between the top of the fans 37*a*, 37*b* and the sides 24, 26 to the air inlets 38.

Preferably, the secondary rings 62 only extend partially around the air inlets 38 such that there is enough space to allow the fans 37*a*, 37*b* to be removed laterally from the blower assembly 10 by removing the upper housings 28, 30, without the first and second sides 24, 26 being removed from the assembly 10. Preferably, the motor 32 is attached to the first and second upper housings 28, 30 such that the first and second upper housings 28, 30, the motor, and the fans 37*a*, 37*b* can be removed as a single unit in order to service the assembly 10.

Figure 5:
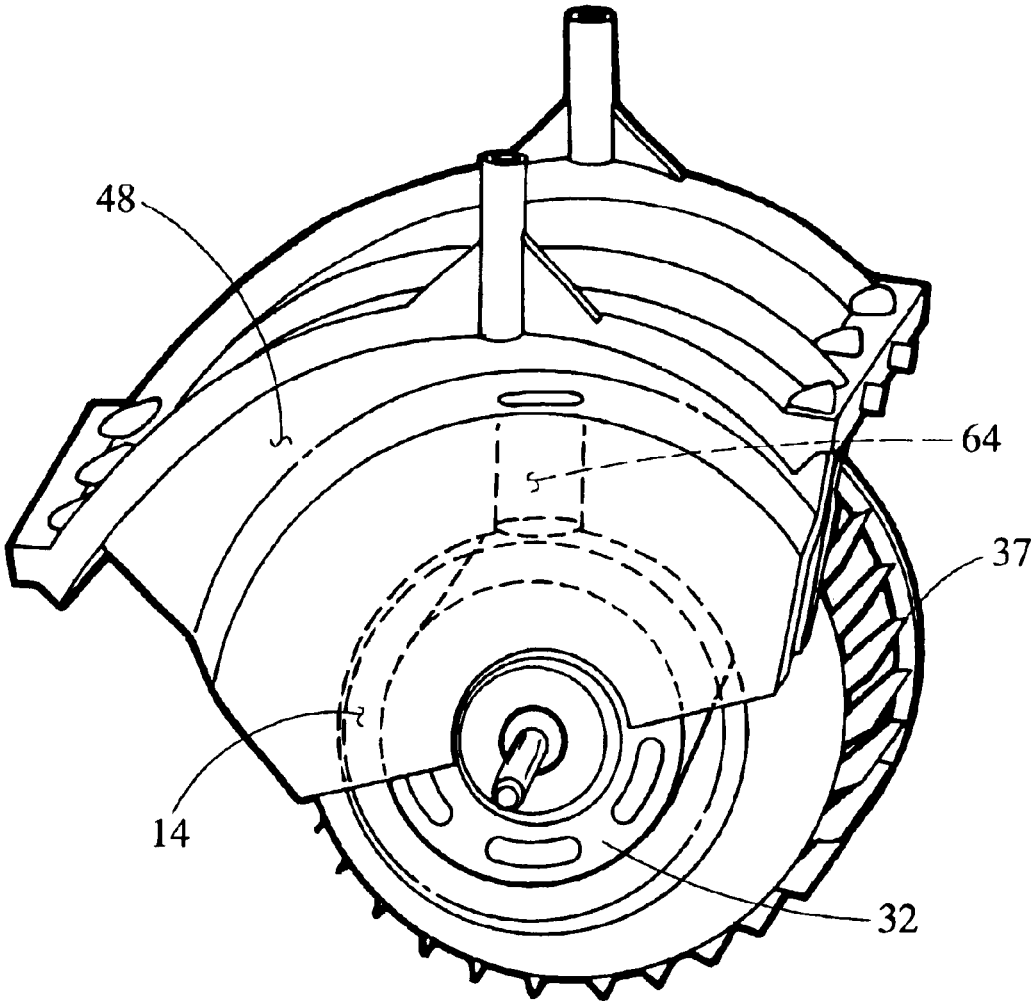
FIG. 5 is a perspective view of a first and second upper housings illustrating the placement of the motor and one of the fans relative to the upper housings and showing a passageway extending between the first scroll chamber and the motor cavity.

Referring to FIGS. 4 and 5, the blower assembly 10 further includes a passage 64 extending between one of the scroll chamber 16 or 18 and the central motor compartment 14. In case the passage 64 is attached to the second scroll chamber, the air will flow from the second scroll chamber 18 to the center motor compartment 14, then through a hole 66 on the motor frame to cool the motor 32. The air will vent from the other side of the motor 32 into the first scroll chamber 16 below the fan 37*a*. In operation, air will flow from the second scroll chamber 18, through the passage 64, and into the central motor compartment 14 and through the motor hole 66 to exit from the motor below the fan 37*a*, because the air within the expansion channel 48 of the second scroll chamber 18 is at higher pressure than the air within the fan 37*a* in the first scroll chamber 16. Preferably the passage 64 extends from the second scroll chamber 18 at a point within the expansion channel 48 as shown.

The foregoing discussion discloses and describes one preferred embodiment of the invention. One skilled in the art will readily recognize from such discussion, and from the accompanying drawings and claims, that changes and modifications can be made to the invention without departing from the fair scope of the invention as defined in the following claims. The invention has been described in an illustrative manner, and it is to be understood that the terminology which has been used is intended to be in the nature of words of description rather than of limitation.

What is claimed is:

1. A dual fan blower module comprising:

a housing defining a central motor compartment and first and second scroll chambers, said scroll chambers being axially aligned with and located on opposite sides of said motor compartment;

a motor mounted within said motor compartment and having first and second shaft ends extending axially therefrom, said first shaft end extending into said first scroll chamber and said second shaft end extending into said second scroll chamber;

a first fan mounted onto said first shaft end within said first scroll chamber for rotational movement within said first scroll chamber and a second fan mounted onto said second shaft end within said second scroll chamber for rotational movement within said second scroll chamber;

each of said first and second scroll chambers including an expansion channel extending axially inward from said scroll chambers toward said motor;

each of said scroll chambers further including an air inlet side having an inlet adapted to allow air to enter said scroll chambers, a bottom side opposite said air inlet side, and a generally cylindrical, curved wall with increasing radius, between the air inlet side and the bottom side, thereby defining a volute chamber through which a volume of air passes, said scroll chambers terminating in an exit and defining a cut-off edge, each of said expansion channels having a start point and extending radially about said scroll chambers from said start point to said exit.

2. The dual fan blower module of claim 1 wherein said start point of each of said expansion channels is located approximately thirty-five degrees radially from said cut-off edges in the direction of fan rotation.

3. The dual fan blower, module of claim 2 wherein each of said expansion channels has en axial depth that increases as said expansion channels extend from said start point to said exit.

4. The dual fan blower module of claim 3 wherein said axial depth of said expansion channels expands linearly.

5. The dual fan blower module of claim 2 wherein each of said expansion channels has a radial height that expands as said expansion channels extend from said start point to said exit.

6. The dual fan blower module of claim 5 wherein said radial height of said expansion channels expands linearly.

7. The dual fan blower module of claim 5 wherein said radial height of said expansion channels expands according to the curvature of said cylindrical wall of said scroll chambers.

8. The dual fan blower module of claim 1 wherein said inlets of said first and second scroll chambers each include a primary inlet ring which radially over-laps said fan and a secondary inlet ring which extends axially into said scroll chambers beyond said fan to reduce air leakage between said fan and said primary inlet ring.

9. The dual fan blower module of claim 8 wherein said secondary inlet rings extend radially about a portion of said inlets, thereby leaving an opening to allow said fans to be removed laterally from said scroll chambers for service.

10. A dual fan blower module comprising:

a housing defining a central motor compartment and first and second scroll chambers, said scroll chambers being axially aligned with and located on opposite sides of said motor compartment;

a motor mounted within said motor compartment and having first and second shaft ends extending axially therefrom, said first shaft end extending into said first scroll chamber and said second shaft end extending into said second scroll chamber;

a first fan mounted onto said first shaft end within said first scroll chamber for rotational movement within said first scroll chamber and a second fan mounted onto said second shaft end within said second scroll chamber for rotational movement within said second scroll chamber;

each of said first and second scroll chambers including an expansion channel extending axially inward from said scroll chambers toward said motor; and a passage extending between one of said scroll chambers and said central motor compartment, said passage being adapted to allow air to flow from said scroll chamber into said central motor compartment and through said motor to exit to said other one of said scroll chambers.

11. The dual fan blower module of claim 10 wherein said passage extends from one of said expansion channels.

12. A dual fan blower module comprising:

a housing defining a central motor compartment and first and second scroll chambers, said scroll chambers being axially aligned with and located on opposite sides of said motor compartment;

a motor mounted within said motor compartment and having first and second shaft ends extending axially therefrom said first shaft end extending into said first scroll chamber and said second shaft end extending into said second scroll chamber;

a first fan mounted onto said first shaft end within said first scroll chamber for rotational movement within said first scroll chamber and a second fan mounted onto said second shaft end within said second scroll chamber for rotational movement within said second scroll chamber;

each of said first and second scroll chambers including an expansion channel extending axially inward from said scroll chambers toward said motor; and said housing including first and second lower housings which include portions that define said motor compartment, and first and second upper housings that are removably mounted onto said first and second lower housings.

13. The dual fan blower module of claim 12 wherein said motor is attached to said first and second upper housings, such that said first and second upper housings, said motor, and said fans are removable as a single unitary component for service.

* * * * *

UNITED STATES PATENT AND TRADEMARK OFFICE

CERTIFICATE OF CORRECTION

PATENT NO. : 6,896,478 B2
DATED : May 24, 2005
INVENTOR(S) : Monier B. Botros et al.

It is certified that error appears in the above-identified patent and that said Letters Patent is hereby corrected as shown below:

Title page,
Item [56], References Cited, U.S. PATENT DOCUMENTS, delete "2/1938" and substitute -- 2/1935 -- in its place.

Column 5,
Line 32, after "channels has" delete "en" and substitute -- an -- in its place.

Signed and Sealed this

Twenty-ninth Day of November, 2005

JON W. DUDAS
*Director of the United States Patent and Trademark Office*